United States Patent [19]

Nakano et al.

[11] Patent Number: 4,699,262

[45] Date of Patent: Oct. 13, 1987

[54] APPARATUS FOR TURNING FLAT ARTICLE POSTURE

[75] Inventors: Takao Nakano; Inou Kensuke, both of Tokyo, Japan

[73] Assignee: NEC Corporation, Japan

[21] Appl. No.: 850,449

[22] Filed: Apr. 9, 1986

Related U.S. Application Data

[63] Continuation of Ser. No. 564,234, Dec. 21, 1983, abandoned.

[30] Foreign Application Priority Data

Dec. 21, 1982 [JP] Japan ..... 57-193516[U]

[51] Int. Cl.[4] ..... D65G 47/24

[52] U.S. Cl. ..... 198/411; 198/415; 271/184; 271/274; 271/275

[58] Field of Search ..... 198/411, 415, 416; 271/184, 185, 225, 272, 293, 274, 275, 314

[56] References Cited

U.S. PATENT DOCUMENTS 3,758,104 9/1973 Daily ..... 198/415 X 4,413,723 11/1983 Stobb ..... 198/415

FOREIGN PATENT DOCUMENTS 0489627 1/1930 Fed. Rep. of Germany ..... 198/411

0033261 3/1977 Japan ..... 198/411

*Primary Examiner*—Robert J. Spar

*Assistant Examiner*—Lyle Kimms

*Attorney, Agent, or Firm*—Laff, Whitesel, Conte & Saret

[57] ABSTRACT

An apparatus for turning the posture of flat articles (such as envelopes and post cards) can stably clamp and turn a flat article accurately, with a 90° rotation. The turning apparatus has a cone roller that is disposed along a path for transporting the flat articles. A first plurality of idler pulleys are independently mounted to engage and be driven by the conical surface of the roller. A second plurality of idler pulleys are disposed on the upstream side of the conical surface, with respect to the first idler pulley. At least one running belt is stretched between the first and second idler pulleys. The angle between the conical surface and the running belt is small enough to reliably grip and turn the flat article.

15 Claims, 7 Drawing Figures

APPARATUS FOR TURNING FLAT ARTICLE POSTURE

This is a continuation of U.S. patent application Ser. No. 06/564,234, filed Dec. 21, 1983, now abandoned.

BACKGROUND OF THE INVENTION

The present invention relates to apparatus for handling flat articles and, more particularly, to apparatus for turning the position of a flat article from a longitudinal posture to a short posture, during the transportation of such an article.

In an apparatus for handling a flat article, such as a mail envelope or a post card, the position of the flat article is frequently turned from a longitudinal posture to a short posture, during the transportation thereof. For instance, the flat article is transferred with the longitudinal posture parallel to the direction of travel in a transport path, during a postal code reading operation. However, during a final sorting operation, it is transferred with the short posture parallel to the direction of travel, so that stackers may be arranged in a high density to stack the flat articles.

According to a prior art technique, such turning of the flat article posture is performed by two cone rollers or by one cone roller and a plurality of idler rollers which have the same diameter and which engage the conical surface of the cone roller to clamp the flat article therebetween. In the rotation of the cone roller, the turning of the flat article posture is effected because the peripheral rotation speed of the cone roller varies according to the surface position along the length of the cone roller. However, in the prior art technique, an overly wide clamping angle is formed in the nip between the two cone rollers or between the cone roller and the idler rollers is too wide. Therefore, there was an imperfect clamping operation therebetween. Consequently, the flat article has not been accurately turned at 90°, and this inaccurateness causes a jam in the transportation system.

SUMMARY OF THE INVENTION

It is, therefore, an object of the invention to provide an apparatus for turning the posture of flat articles. Another object is to stably clamp a flat article and to turn it accurately to a new flat article posture, with the turn at 90°.

According to the present invention, an apparatus for turning the posture of a flat article uses a cone roller which is disposed along a transport path, through which a flat article travels. A first plurality of idler rotational means are each independently designated to engage the surface of a cone roller. A second plurality of idler rotation means are disposed at the same side and at an upstream position with respect to the first idler rotation means. At least one belt is stretched between the first and second idler rotation means.

DESCRIPTION OF THE PREFERRED EMBODIMENTS

Figure 1:
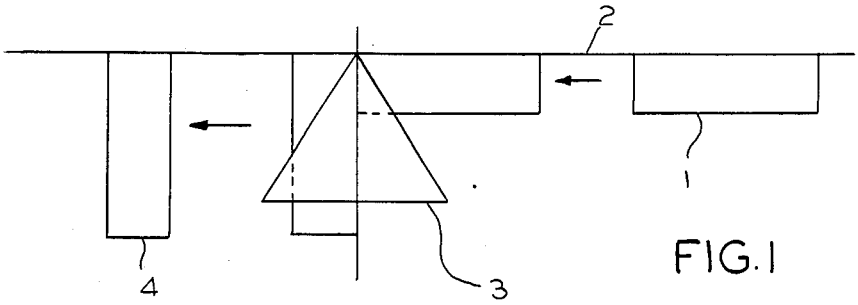
FIG. 1 shows a principle which is used to turn the position of a flat article, by means of a cone roller.

In FIG. 1, a flat article 1 is transferred through a transport path 2 with its longitudinal posture parallel to the direction of travel (shown by two arrows). Article 1 is being transported during an operation for reading a postal code, and the posture of the flat article is turned to the short direction by a cone roller 3. The posture of the turned flat article 4 is perpendicular to the posture at 1, after the article is delivered from the cone roller 3. This is because the peripheral speed of the surface of the cone roller varies along the length of the cone depending on the position, i.e., the surface speed on a greater periphery is greater than the surface speed on a smaller periphery.

Figure 2A:
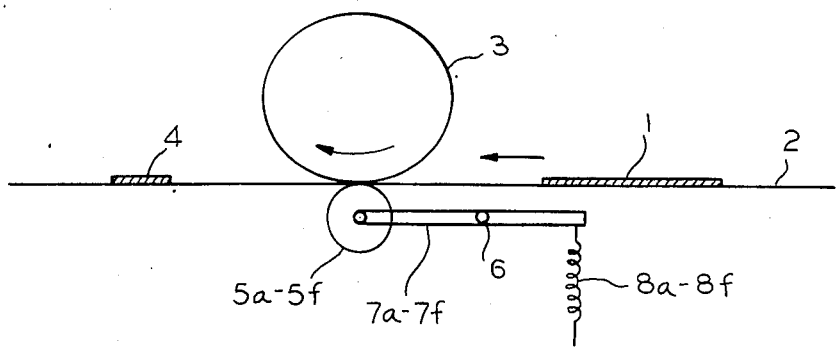
FIG. 2(a) (PRIOR ART)
FIGS. 2(*a*) and 2(*b*) schematically show a prior art apparatus for turning the posture of a flat article.
Figure 2B:
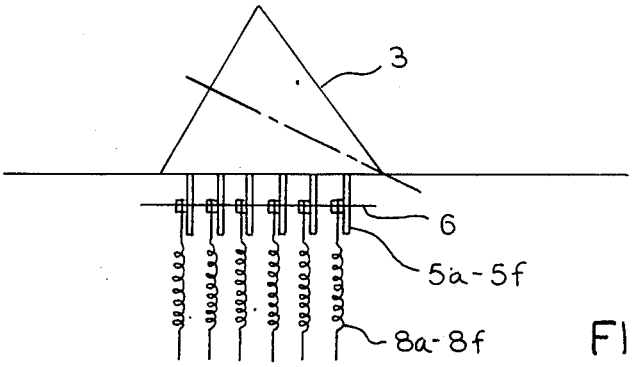
FIG. 2(b) (PRIOR ART)

From the viewpoint of cost, it is an ordinary way to use one cone roller and a plurality of small idler rollers. Figs. 2(*a*) and 2(*b*) show the prior art technique. A plurality of idler rollers 5*a* to 5*f*, all having the same diameter, are provided at ends of arms 7*a* to 7*f* and are independently engaged with the surface of cone roller 3. Springs 8*a* to 8*f* are connected at the opposite ends of the arms 7*a* to 7*f* to apply pressure between the idler rollers 5*a* to 5*f* and the cone roller 3.

Figure 3:
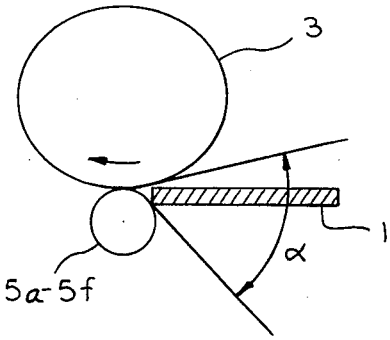
FIG. 3 shows a clamping operation which is performed according to the prior art.

In the prior art technique shown in FIGS. 2(*a*) and 2(*b*), however, a clamping angle $\alpha$ (FIG. 3), which is formed in the nip between the cone roller 3 and the idler rollers 5*a* to 5*f*, is so wide that the clamping operation of the flat article often fails. Therefore, the posture turn of 90° is not performed accurately and this causes a jam in a later process.

Figure 4:
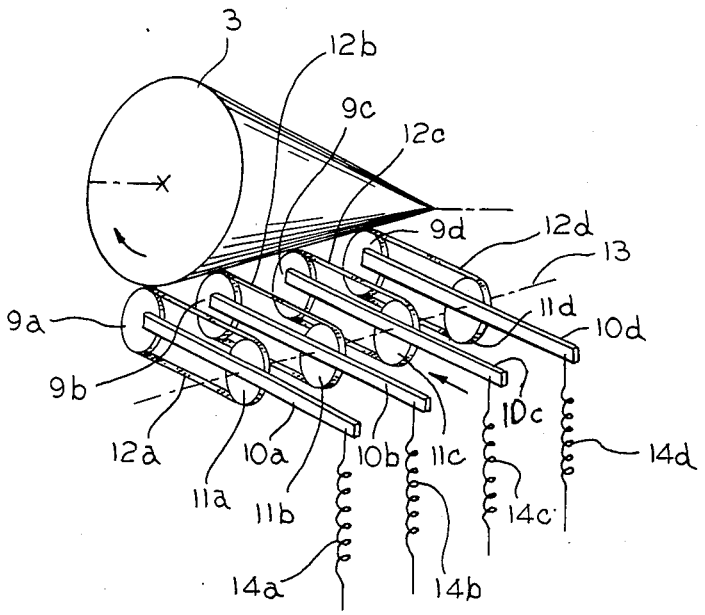
FIG. 4 shows a first embodiment of the present invention.
Figure 5:
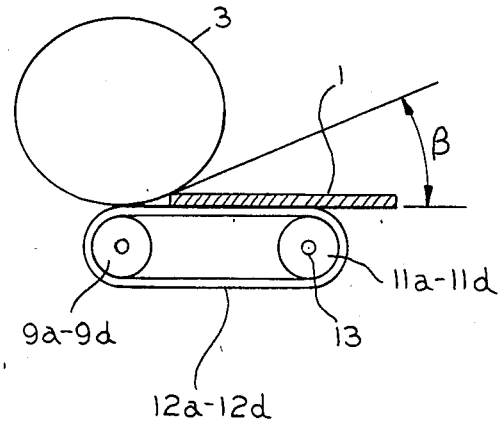
FIG. 5 shows a clamping operation performed according to the present invention.

FIG. 4 shows a first embodiment of the present invention. A plurality of pulleys 9*a* to 9*d* are provided at first ends of arms 10*a* to 10*d*, which extend in parallel with a transport path (not shown), and are disposed to engage the surface of cone roller 3. The arms 10*a* to 10*d* also carry other pulleys 11a to 11*d* at their centers and at a position which is upstream of the cone roller 3. Supporting belts 12*a* to 12*d* are stretched between corresponding pulleys 9*a* to 9*d* and pulleys 11*a* to 11*d*. Springs 14*a* to 14*d* are provided at the opposite ends of the arms 10*a* to 10*d* to force the pulleys 9*a* to 9*d* into engagement on the surface of cone roller 3. Arms 10*a*–10*d* pivot around an axis 13. In this example, pulleys 9*a* and 11a, for example, are an associated pair of pulleys and running belt 12*a* is trained over the associated pair. The remaining associated pairs have a similar arrangement. The cone roller 3 is rotated at a constant speed to drive the belts 12*a* to 12*d* stretched between the pulleys 9*a* to 9*d* and the pulleys 11*a* to 11*d*. As shown in FIG. 5, according to the present invention, a clamping angle $\beta$ is formed in the nip between the cone roller 3 and the belts 12*a* to 12*d*. Nip angle $\beta$ is smaller than the nip angle $\alpha$, shown in FIG. 3, the prior art. The flat article is stably clamped by small angles $\beta$ and is turned accurately through 90°. Furthermore, in the present invention, the substantial length of the running belts 12*a* to 12*d* (i.e., the distance between the rotation centers of the pulleys 9*a* to 9*d* and 11*a* to 11*d*) is shorter than the length of the flat article as shown in FIG. 5.

Figure 6:
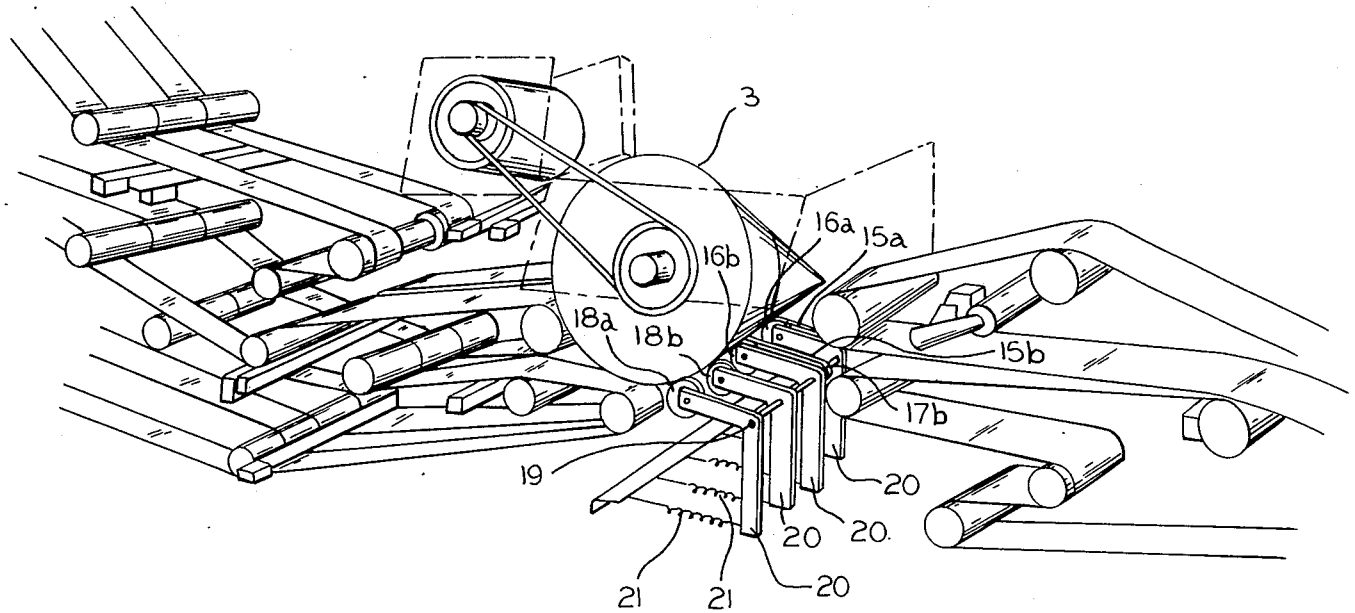
FIG. 6 shows a second embodiment of the present invention.

FIG. 6 shows a second embodiment of the present invention, wherein only two belts are provided to clamp a flat article. More specifically, only two belts 15*a* and 15*b* are stretched between pulleys 16*a* and 16*b* and pulleys 17*a* and 17*b*. These belts engage cone roller 3 near the center of the turning position. Further, two idler rollers 18*a* and 18*b* engage the cone roller 3 in addition to the pulleys 16*a* and 16*b* and pulleys 17*a* and 17*b*. In this embodiment, arms 20, carrying the pulleys 16 and 17 and idler rollers 18, have an L-shape, and are forced to turn around axis 19 by springs 21. In FIG. 6, flat article transport arrangements are also disclosed in front of and behind the cone roller 3.

As described above, according to the present invention, the clamping angle formed between the cone roller and the belt becomes narrow, so that the flat article is clamped stably and is accurately turned 90°.

Those who are skilled in the art will readily perceive how to modify the invention. Therefore, the appended claims are to be construed to cover all equivalent structures which fall within the true scope and spirit of the invention.

What is claimed is:

1. An apparatus for turning the posture of flat articles moving along a transport path extending upstream and downstream from said apparatus, comprising:

a cone roller having a conical side surface and being disposed along said path for transporting the flat articles;

at least three first rotation means each independently positioned to engage the side surface of said cone roller which is on the upstream side of said transport path;

at least three second rotation means disposed at the same side of said surface and located away from said surface at a position which is upstream with respect to said first rotation means; and at least three narrow running belts stretched between said first and second rotation means, whereby the flat articles are gripped within a relatively small angle formed between said conical side surface and said running belts.

2. The apparatus as claimed in claim 1, in which both said first and second rotation means include a pulley.

3. The apparatus as claimed in claim 1, in which said running belts are in movable contact with said side surface of said cone roller.

4. The apparatus as claimed in claim 1, in which the pairs of said first and second rotation means are carried by individually associated arms which are swingable around an axis to cause said first rotation means to engage the side surface of said cone roller.

5. A mail article alignment device comprising first conveying means for conveying a mail article from an upstream position in a first alignment, conical roller means for receiving mail articles delivered from said first conveying means, a plurality of individual pulley means and for turning the posture of the mail articles pulley means being provided between said first conveying means and said conical roller means, a distance of each associated pair of pulley means being shorter than a length of said mail articles, spring biased means for supporting to said each of the associated pairs of said pulley means and the associated belts belts being positioned adjacent the surface of said conical roller means to form a relatively small nip angle therewith, and second conveying means for conveying mail articles emerging from the nip between said conical roller means and said belts to a downstream position of said conical roller means, the surface configuration of said conical roller means rotating said mail article from said first alignment to a second alignment.

6. The alignment device of claim 5 wherein said spring bias means comprises an arm having said associated pair of pulley means rotatably mounted thereon, one of said pair of pulley means being at one end of said arm and the other of said pair of pulley means being at a location which is displaced from said end, said arm being mounted to pivot about a point which enables the pulley means mounted on its end to be urged toward said conical surface, and spring bias means associated with said arm for so urging pulley means toward said surface.

7. The alignment device of claim 6 wherein said arm is straight, said displaced location is between the ends of and along the length of said arm, and said spring means is connected to said arm near the end opposite said one end.

8. The alignment device of claim 6 wherein said arm has an "L-shape", said displaced location being on the same arm of said L-shape that includes said one end, and said spring means being associated with the other arm of said L-shape.

9. A device for turning a mail article which is being transported along a predetermined path, said turning means comprising a conical roller, a plurality of spaced parallel running belts having an effective length which is shorter than the length of said mail article and forming a nip with said conical roller at a relatively small angle to reliably cooperate with said conical roller in order to grip said mail article, said roller having a conical surface configuration which turns said mail articles by 90°.

10. The apparatus as claimed in claim 1, in which the distance between said first rotation means and said second rotation means is at a distance which is shorter than a length of said flat articles.

11. An apparatus for turning the posture of flat articles moving along a transport path extending upstream and downstream from said apparatus, comprising:

a cone roller having a conical side surface and being disposed along said path for transporting the flat articles;

at least three first rotation means each being independently positioned to engage the side surface of said cone roller which is on the upstream side of said transport path, said at least three first rotation means holding a flat article while said flat article is being turned by said cone roller;

at least two second rotation means disposed at the same side of said surface and being positioned at a distance which is removed from said surface to a location which is upstream with respect to said first rotation means; and at least two narrow running belts stretched between said first and second rotation means, whereby the flat articles are gripped within a relatively small angle formed between said conical side surface and said running belts.

12. The apparatus as claimed in claim 11, in which the distance between said first rotation means and said second rotation means is a distance which is shorter than a length of said flat articles.

13. An apparatus for turning the posture of flat articles, said apparatus comprising:

first conveyor means for conveying flat articles, said first conveyor means comprising a pair of conveying belts;

a rotating cone roller disposed apart from said first conveyor means to provide a certain space between the end of said first conveyor means and said rotating cone roller for turning the posture of said flat article by 90° while the side surface of said rotating cone roller is in contact with said flat article;

a second conveyor means disposed on the downstream of said rotating cone roller for conveying said flat article delivered from said rotating cone roller;

a plurality of first rotation means, each of said first rotating means being independently disposed to engage the side surface of said rotating cone roller;

a plurality of second rotation means placed in said certain space, each of said second rotation means being independently disposed at the same side of said surface and located away from said surface at a position which is upstream with respect to said first rotation means; and a supporting belt stretched between each pair of said first and second rotation means; whereby flat articles are gripped within a relatively small angle formed between said side surface and said supporting belts.

14. The apparatus as claimed in claim 13, in which both said first and second rotation means include a pulley, the pulleys of said first and second rotation means forming associated pairs of said pulleys, and the supporting belts being stretched between said associated pairs of said pulleys of said first and second rotation means.

15. The apparatus as claimed in claim 13, in which said supporting belts are in movable contact with said surface of said rotating cone roller.

* * * * *